US006508695B2

(12) United States Patent
Tanikawa et al.

(10) Patent No.: US 6,508,695 B2
(45) Date of Patent: Jan. 21, 2003

(54) PURE WATER REUSING SYSTEM

(75) Inventors: Mutsumi Tanikawa, Yokohama (JP); Mitsunori Komatsu, Fujisawa (JP); Kiyotaka Kawashima, Yokohama (JP); Hiroshi Shimomoto, Yokohama (JP); Katsuya Okumura, Tokyo (JP)

(73) Assignees: Ebara Corporation, Tokyo (JP); Kabushiki Kaisha Toshiba, Kanagawa-Ken (JP)

( * ) Notice: Subject to any disclaimer, the term of this patent is extended or adjusted under 35 U.S.C. 154(b) by 0 days.

(21) Appl. No.: 09/817,206

(22) Filed: Mar. 27, 2001

(65) Prior Publication Data

US 2001/0034190 A1 Oct. 25, 2001

(30) Foreign Application Priority Data

Mar. 28, 2000 (JP) ..... 2000-088246

(51) Int. Cl.[7] ..... B24B 1/00

(52) U.S. Cl. ..... 451/41; 451/60; 451/287; 451/446; 210/194; 210/195.3; 210/636; 210/651

(58) Field of Search ..... 451/41, 60, 287, 451/446; 210/194, 195.3, 636, 651

(56) References Cited

U.S. PATENT DOCUMENTS

| | | | | |
|---|---|---|---|---|
| 5,542,441 A | * | 8/1996 | Mohindra et al. | 134/95.2 |
| 5,855,792 A | * | 1/1999 | Adams et al. | 210/696 |
| 6,077,437 A | * | 6/2000 | Hayashi et al. | 210/651 |
| 6,165,048 A | * | 12/2000 | Russ et al. | 451/5 |

FOREIGN PATENT DOCUMENTS

| | | |
|---|---|---|
| JP | 11-90434 | 4/1999 |
| JP | 11-300352 | 11/1999 |
| JP | 2000-190223 | 7/2000 |
| JP | 2000-308967 | 11/2000 |

* cited by examiner

*Primary Examiner*—Joseph J. Hail, III
*Assistant Examiner*—Shantese McDonald
(74) *Attorney, Agent, or Firm*—Wenderoth, Lind & Ponack, L.L.P.

(57) ABSTRACT

A pure water reusing system recovers water discharged from apparatuses in which pure water is used, and regenerates the water to produce pure water. The pure water reusing system has a recovering and regenerating apparatus for recovering water discharged from the apparatuses and regenerating the water by removing impurities from the water to produce pure water, and a regenerated pure water supply line for supplying the regenerated pure water to at least one of the apparatuses. The same process is conducted in the apparatuses in which pure water is used.

10 Claims, 5 Drawing Sheets

PURE WATER REUSING SYSTEM

BACKGROUND OF THE INVENTION

1. Field of the Invention

The present invention relates to a pure water reusing system for recovering and regenerating water discharged from an apparatus in which pure water is used, e.g., a polishing apparatus for polishing a substrate such as a semiconductor wafer, and supplying the regenerated pure water to an apparatus in which pure water is used.

2. Description of the Related Art

A large amount of pure water is used in a semiconductor fabrication plant. The production of pure water is expensive, and the disposal of used pure water as waste water results in increased cost. Therefore, in order to reduce the cost, a water reusing system has heretofore been used for recovering and regenerating water discharged from an apparatus in which pure water is used, and reutilizing the regenerated pure water. According to this conventional water reusing system, water discharged from all apparatuses used in all production processes is collected and regenerated in a batch process. Therefore, the conventional water reusing system involves the following problems.

If water discharged from different production processes is mixed, by-products are generated due to the adverse effect of impurities contained in the waste water. Further, since various kinds of waste liquid such as acidic liquid or alkaline liquid are mixed with waste water, a large number of steps are required in order to process and regenerate the recovered waste water. Furthermore, it is necessary to recover and regenerate the waste water respectively in separate devices, thereby increasing the scale of the processing facilities.

Further, in the conventional reusing system, the regenerated pure water is supplied to respective apparatuses through a common supply line. Therefore, the regenerated pure water cannot be supplied from the reusing system to the respective apparatuses while the pressure of the regenerated pure water is independently controlled for each of the apparatuses.

SUMMARY OF THE INVENTION

The present invention has been made in view of the above drawbacks. It is therefore an object of the present invention to provide a pure water reusing system which can simplify a process for regenerating water recovered from an apparatus in which pure water is used, and can supply the an apparatus in which pure water is of the regenerated pure water is controlled for each of regenerated pure water regenerated pure water to used while the pressure independently supply lines.

In order to attain the above object, according to one aspect of the present invention, there is provided a pure water reusing system for recovering water discharged from apparatuses in which pure water is used, and regenerating the water to produce pure water. The system comprises a recovering and regenerating apparatus for recovering water discharged from the apparatuses and regenerating the water by removing impurities from the water to produce pure water, the same process being conducted in the apparatuses in which pure water is used, and a regenerated pure water supply line for supplying the regenerated pure water to at least one of the apparatuses. The regeneration of water is to regenerate water to produce pure water.

Thus, an apparatus in which pure water is used and from which pure water is recovered and an apparatus in which pure water is used and to which the regenerated pure water is supplied are utilized for the same production process. Therefore, water to be recovered can be prevented from being contaminated by undesired waste water or chemical liquid. Further, a processing process in a regeneration device can be simplified to reduce the size of the regeneration device. Furthermore, since the apparatuses are utilized for the same process, it is not necessary to increase the purity of the regenerated pure water to a high level.

According to a preferred aspect of the present invention, the pure water reusing system further comprises at least one regenerated pure water supply line, and a supply pressure control mechanism for supplying the regenerated pure water at an independent water pressure for each of the regenerated pure water supply lines.

With the supply pressure control mechanism, the regenerated pure water can be supplied at a pressure suitable for operating conditions of the apparatus in which pure water is used and to which the regenerated pure water is supplied. Further, the regenerated pure water can be utilized for a process requiring pure water having a pressure higher than that in the normal process.

According to another preferred aspect of the present invention, the supply pressure control mechanism is capable of varying the supply pressure of the regenerated pure water in response to a signal from at least one of the apparatuses.

Since the supply pressure control mechanism can vary the supply pressure of the regenerated pure water in response to a signal from the apparatus in which pure water is used, the regenerated pure water can be supplied at a desired pressure according to required conditions, so that each of the apparatuses in which pure water is used can utilize the pure water under optimal operating conditions.

According to still another preferred aspect of the present invention, a pure water reusing system further comprises a switch valve for switching a passage of the water discharged from at least one of the apparatuses between a recovery line for recovering the water and a waste water line for discharging the water, wherein the passage of the water is switched between the recovery line and the waste water line according to condition of the water discharged from the at least one of the apparatuses.

Thus, the passage of the water is switched between the recovery line and the waste water line according to the condition of the water discharged from the apparatus in which pure water is used. Therefore, water contaminated by impurities and unsuitable for recovery can be prevented from flowing into the recovery line, thus improving the operating efficiency of the system.

According to another aspect of the present invention, there is provided a polishing system for polishing a substrate. The polishing system comprises a polishing apparatus for conducting a polishing process of a substrate using pure water, a water recovery section for recovering water used in the polishing process, and a recovery line for allowing the water used in the polishing process to flow into the water recovery section.

According to a preferred aspect of the present invention, the water recovery section recovers water which has been used for a predetermined process.

According to another preferred aspect of the present invention, the polishing system further comprises a regeneration section for regenerating the water recovered by the water recovery section to produce pure water.

In this case, it is desirable that a pair of the water recovery section and the regeneration section is provided for a plurality of polishing apparatuses. Preferably, at least one of the water recovery section and the regeneration section comprises a sensor for detecting whether the water is suitable for regeneration. In this case, the sensor may comprise one of an optical turbidimeter, a pH meter, and a particle counter.

According to still another preferred aspect of the present invention, the regenerated pure water is utilized for dressing a polishing surface which contacts a substrate to polish a surface of the substrate.

According to another preferred aspect of the present invention, the polishing apparatus further comprises a recirculating line for allowing water to be circulated through the water recovery section and the regeneration section and the polishing apparatus. In this case, a sensor for measuring the flow rate of water in the recirculating line may be provided. Further, it is desirable that the recirculating line comprises a supplementary pure water line for adding supplementary pure water to the regenerated pure water.

According to still another aspect of the present invention, there is provided a method for polishing a substrate. The method comprises conducting a polishing process of a substrate using pure water, and recovering water which has been used for the polishing process.

According to a preferred aspect of the present invention, the method for polishing a substrate further comprises regenerating the recovered water to produce pure water. In this case, it is desirable that the method further comprises dressing a polishing surface with the regenerated pure water.

The above and other objects, features, and advantages of the present invention will be apparent from the following description when taken in conjunction with the accompanying drawings which illustrates preferred embodiments of the present invention by way of example.

BRIEF DESCRIPTION OF THE DRAWINGS

FIG. 2A shows a case where regenerated pure water is sprayed in an atomized state and FIG. 2B shows a case where a polishing surface is dressed with regenerated pure water;

FIG. 3A shows a case where regenerated pure water is poured over a cover provided around a polishing table, FIG. 3B shows a case where a top ring is cleaned with regenerated pure water, and FIG. 3C shows a case where a dresser is cleaned with regenerated pure water;

DETAILED DESCRIPTION OF THE PREFERRED EMBODIMENTS

An embodiment of the present invention will be described below with reference to the accompanying drawings. In the present embodiment, a polishing apparatus is used as an example of an apparatus in which pure water is used. However, the apparatus in which pure water is used is not limited to a polishing apparatus, and any apparatus in which pure water is used maybe used.

Figure 1:
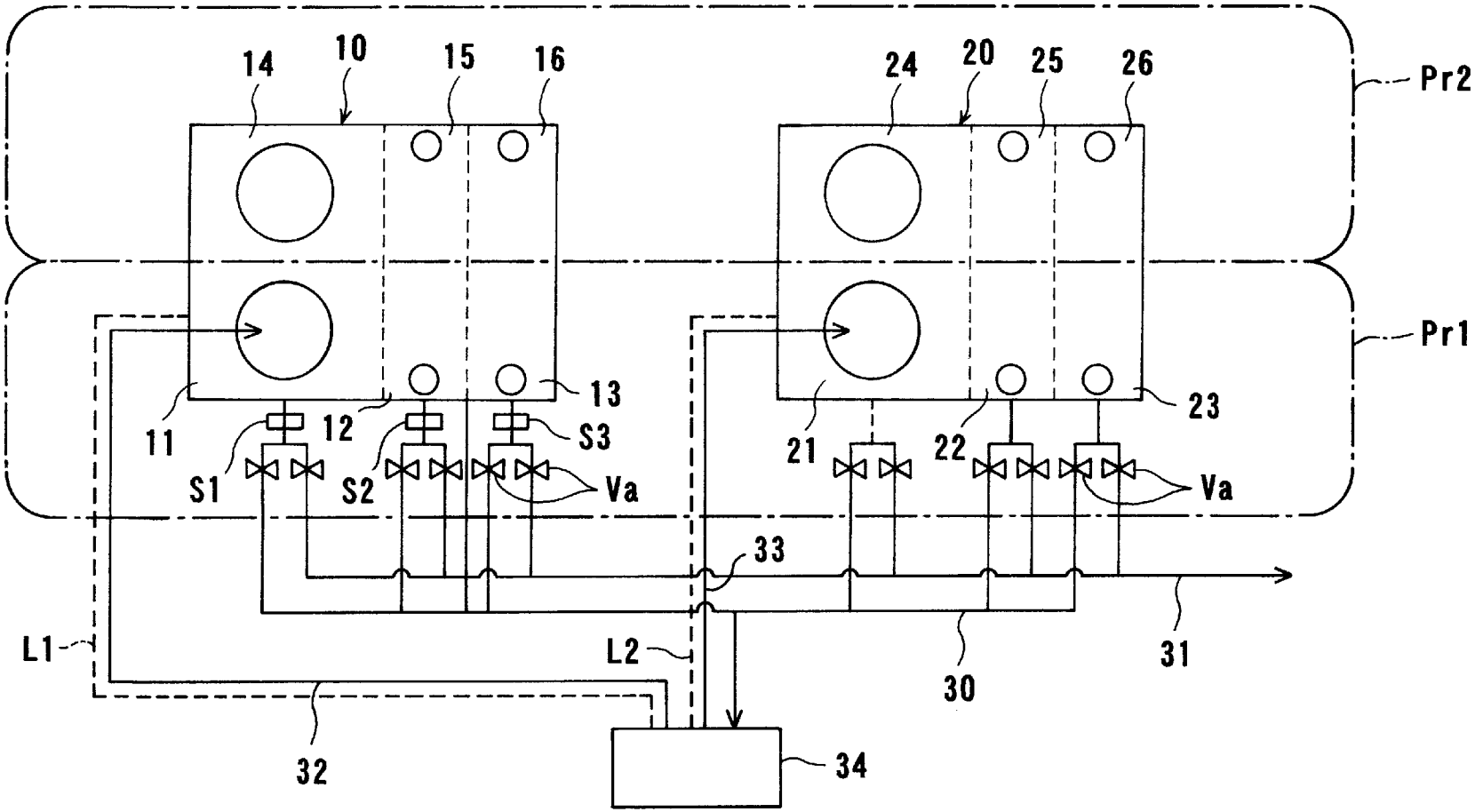
FIG. 1 is a schematic diagram showing a configuration of a pure water reusing system according to an embodiment of the present invention.

FIG. 1 shows a configuration of a pure water reusing system according to an embodiment of the present invention. This pure water reusing system is used in a semiconductor fabrication process for polishing a thin film of copper, tungsten, $SiO_2$, or the like formed on a substrate, such as a semiconductor wafer. In the pure water reusing system, water discharged from polishing apparatuses which polish films of the same material is recovered and regenerated, and the regenerated pure water is supplied to polishing apparatuses which polish films of the same material as in the apparatuses from which the used water has been recovered. In FIG. 1, the reference numerals 10, 20 denote a polishing apparatus (CMP apparatus), respectively, for conducting a polishing process of a substrate, such as a semiconductor wafer, using pure water. The polishing process comprises at least a polishing step for polishing a surface of the substrate and a dressing step for dressing a polishing surface to regenerate the polishing surface. The polishing apparatus 10 comprises two mechanisms 11, 14, two substrate cleaning mechanisms 12, 15, and two substrate cleaning and drying mechanisms 13, 16. The polishing apparatus 20 comprises two substrate polishing mechanisms 21, 24, two substrate cleaning mechanisms 22, 25, and two substrate cleaning and drying mechanisms 23, 26.

Substrates on which films of the same material are formed are processed in a production process line Pr1, which comprises the substrate polishing mechanism 11, the substrate' cleaning mechanism 12, and the substrate cleaning and drying mechanism 13 in the polishing apparatus 10, and the substrate polishing mechanism 21, the substrate cleaning mechanism 22, and the substrate cleaning and drying mechanism 23 in the polishing apparatus 20. Water discharged from the substrate polishing mechanisms 11, 21, the substrate cleaning mechanisms 12, 22, and the substrate cleaning and drying mechanisms 13, 23 in the same production process Pr1 is recovered through a recovery line 30 by a water recovery and regeneration apparatus 34. The water recovery and regeneration apparatus 34 comprises a water recovery section and a regeneration section. There are provided switching valves Va for switching passages of water discharged from the polishing apparatuses 10, 20 between the recovery line 30 and a waste water line 31.

When water which contains foreign material, such as a solid material or an acid- or alkali-containing polishing chemical liquid and is not suitable for regeneration, is discharged, depending on the kind of film which has been polished, the discharged water is introduced through the switch valve Va to the waste water line 31 and discharged to the exterior of the system. If the water unsuitable for regeneration has been recovered, then the acid and the alkali cause a neutralization reaction in the water recovery and regeneration apparatus 34 to produce a salt. In some solid materials, the necessary frequency of maintenance of the apparatus is increased. In some cases, the mixing of some chemical liquid such, as an additive with pure water, adversely affects the polishing rate.

Water suitable for regeneration is introduced through the switch valve Va to the water recovery and regeneration apparatus 34. Whether water is suitable for regeneration or not is detected by sensors S1, S2 and S3 provided in the recovery line 30. For example, an optical turbidimeter, a pH meter, or a particle counter is used as the sensors S1, S2 and S3. In the water recovery and regeneration apparatus 34, regeneration treatment such as removal of impurities from the recovered water is carried out. The regenerated pure water is supplied to the substrate polishing mechanism 11 in the polishing apparatus 10 and the substrate polishing mechanism 21 in the polishing apparatus 20, respectively, through regenerated pure water supply lines 32, 33 provided independently of each other.

Supply pressure control mechanisms (described later on) capable of supplying the regenerated pure water at an independent pressure to the substrate polishing mechanisms 11, 21 are provided in each of the regenerated pure water supply lines 32, 33. With these supply pressure control mechanisms, the regenerated pure water is supplied at respective desired pressures to the substrate polishing mechanisms 11, 21 in response to a signal sent from the polishing apparatuses 10, 20 through communication lines L1, L2.

A production process line Pr2 comprises the substrate polishing mechanism 14, the substrate cleaning mechanism 15, and the substrate cleaning and drying mechanism 16 in the polishing apparatus 10, and the substrate polishing mechanism 24, the substrate cleaning mechanism 25, and the substrate cleaning and drying mechanism 26 in the polishing apparatus 20. Water discharged from these mechanisms in the production process line Pr2 is recovered by the water recovery and regeneration apparatus. The recovered water is regenerated and the regenerated pure water is supplied through respective independent regenerated pure water supply lines to the substrate polishing mechanisms 14, 24, although this configuration is not shown in FIG. 1. Further, the present system is constructed so that waste liquid containing a slurry which is discharged from the substrate polishing mechanisms 11, 21, 14 and 24 is recovered and regenerated to produce pure water.

Figure 2A:
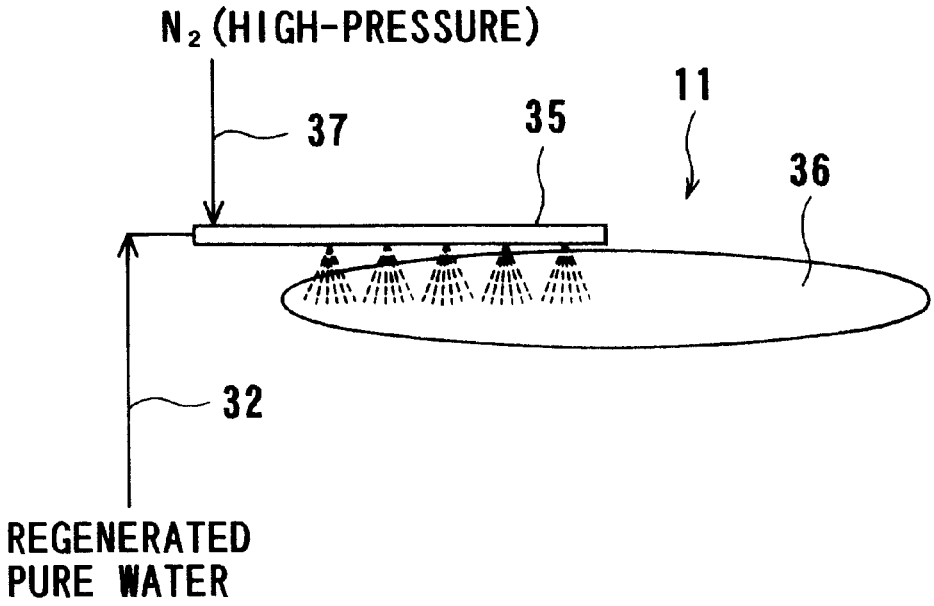
FIGS. 2A and 2B are schematic diagrams showing examples of using regenerated pure water in a substrate polishing mechanism according to the present invention.
Figure 2B:
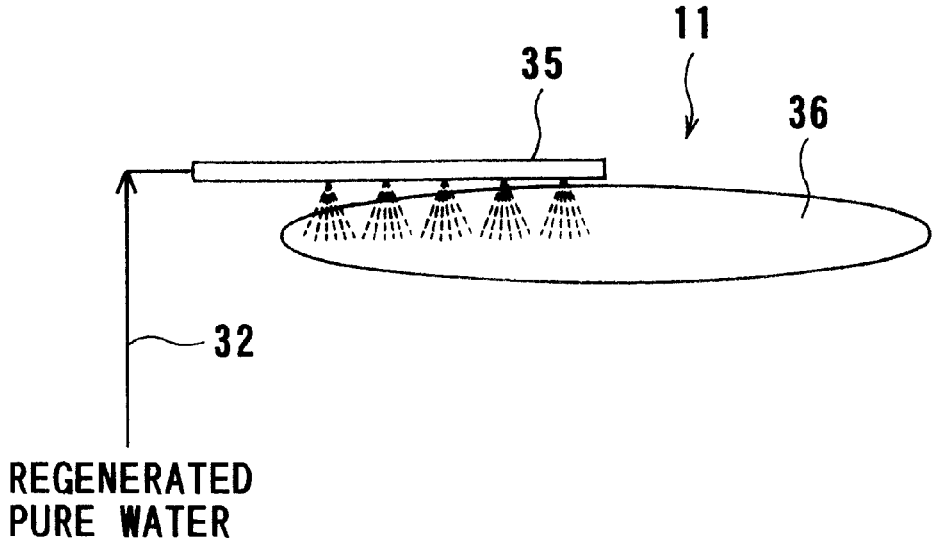

FIGS. 2A and 2B are schematic diagrams showing examples of using regenerated pure water in a substrate polishing mechanism. FIG. 2A shows a case where regenerated pure water is sprayed in an atomized state, and FIG. 2B shows a case where a polishing surface 36 is dressed with regenerated pure water for thereby regenerating the polishing surface 36.

When the regenerated pure water is sprayed in an atomized state, as shown in FIG. 2A, the regenerated pure water is supplied to a nozzle 35 at a relatively low pressure (e.g., 0.3 MPa) through the regenerated pure water supply line 32, and high-pressure nitrogen ($N_2$ gas is supplied at a pressure of 0.3 to 0.7 MPa, for example, through a high-pressure gas supply line 37. Thus, a mixed fluid of regenerated pure water and nitrogen gas is sprayed in an atomize state onto the polishing surface 36 of the polishing table to clean the polishing surface 36.

When the polishing surface is dressed with the regenerated pure water, as shown in FIG. 2B, the regenerated pure water is supplied at a high pressure (e.g., 1 MPa) to the nozzle 35 through the regenerated pure water supply line 32 and is ejected at a high speed from the nozzle 35 onto the polishing surface 36. The regenerated pure water can be supplied at a predetermined pressure according to the required conditions in the substrate polishing mechanism 11. Thus, the regenerated pure water is utilized for dressing the polishing surface.

Figure 3A:
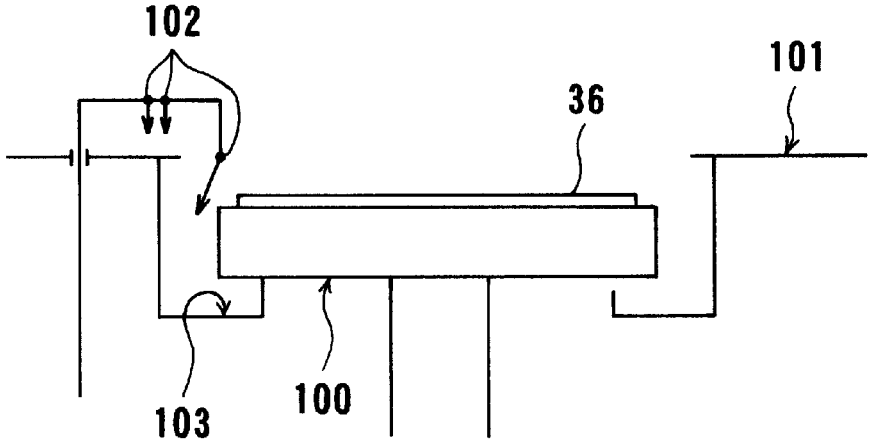
FIGS. 3A through 3C are schematic diagrams showing other examples of using regenerated pure water in the substrate polishing mechanism according to the present invention.
Figure 3B:
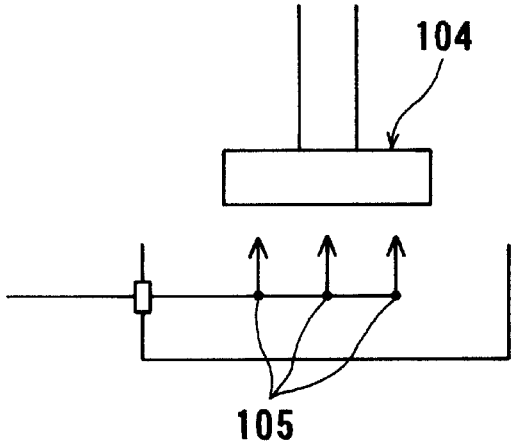
Figure 3C:
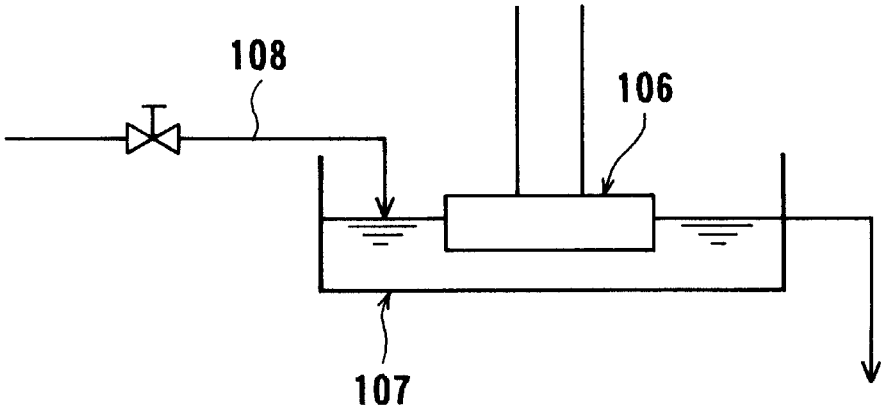

FIGS. 3A through 3C are schematic diagrams showing other examples of using regenerated pure water in a substrate polishing mechanism.

FIG. 3A shows a case where regenerated pure water is poured over a cover 101 provided around a polishing table 100. Slurry used during polishing is often attached to the surface of the cover 101 provided around the polishing table 100. By pouring the regenerated pure water over the surface of the cover 101 from a nozzle 102, the slurry can be prevented from being attached or fixed to the surface of the cover 101. The regenerated pure water poured over the cover 101 flows into a waste water pit 103 provided around the polishing table 100, together with scattered slurry. The regenerated pure water is also poured over the waste water pit 103 to prevent the slurry from being attached thereto.

FIG. 3B shows a case where a top ring head 104 for holding a substrate to be polished is cleaned. Regenerated pure water is ejected upward from nozzles 105 toward a surface of the top ring head 104 on which the substrate to be polished is held. This cleaning of the top ring head 104 may be performed after a polished substrate is removed from the top ring head 104.

FIG. 3C shows a cleaning tub 107 for cleaning a dresser 106. The dresser 106 has, on the lower surface thereof, a dressing tool, such as a plate (not shown), with electrodeposited diamond particles, or a brush (not shown), and the dressing tool is brought into contact with the polishing surface 36 to perform dressing. In FIG. 3C, regenerated pure water is supplied through a supply line 108 to the cleaning tub 107 to prevent the dresser 106 from drying out.

Figure 4:
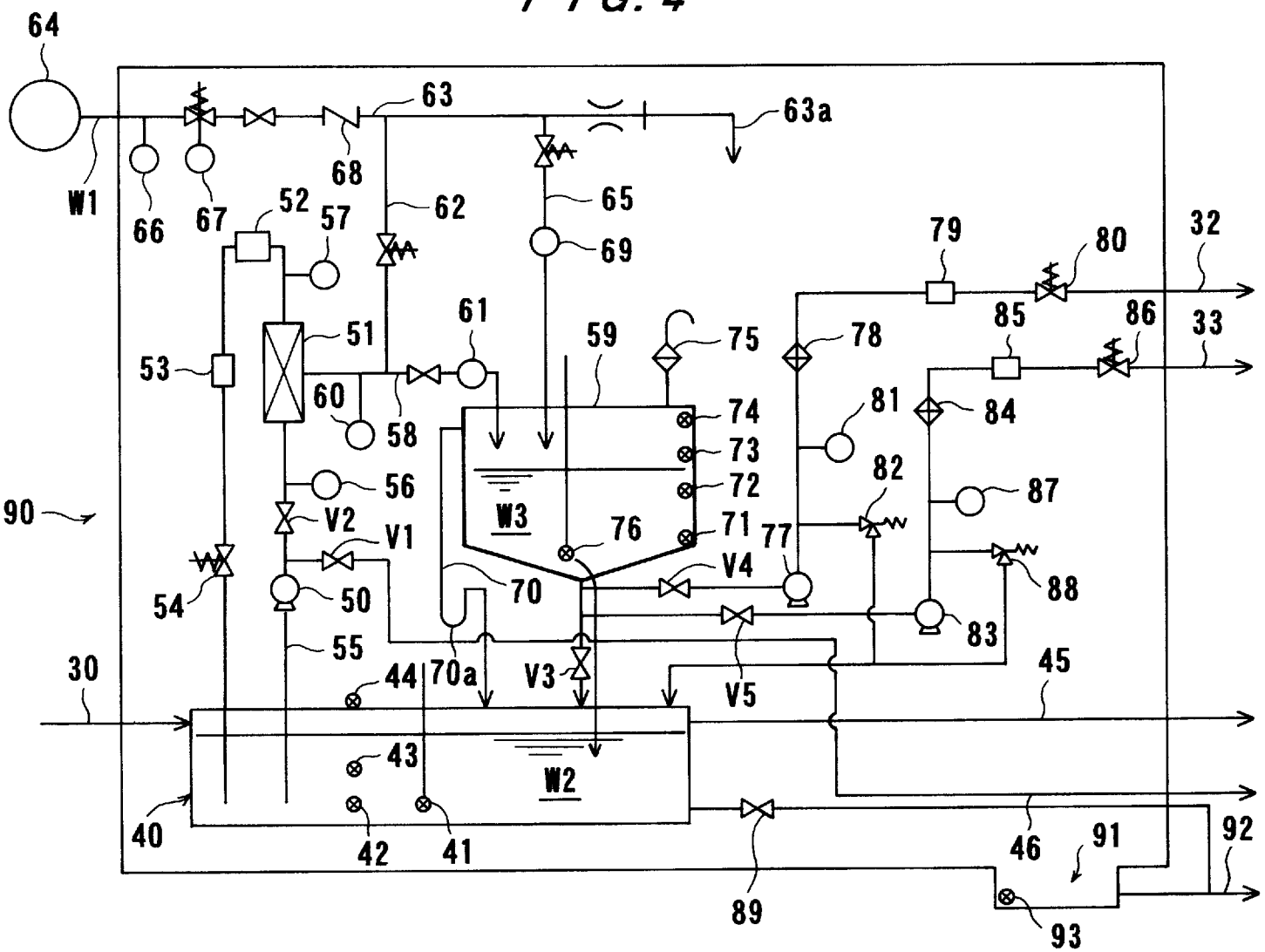
FIG. 4 is a schematic diagram showing an example of the configuration of a pure water reusing system according to the present invention.

FIG. 4 is a schematic diagram showing an example of a configuration of the water recovery and regeneration apparatus 34. The water recovery and regeneration apparatus 34 has a primary tank 40. Water discharged from the polishing apparatuses 10, 20 is allowed to spontaneously flow down and is recovered in the primary tank 40 through the recovery line 30. In the primary tank 40, there are provided a pH sensor 41 for detecting pH value, a water level sensor 42 for detecting low water level, a water level sensor 43 for detecting high water level, a water level sensor 44 for detecting maximum water level, and a waste water line 45.

The reference numeral 50 denotes a circulation pump, the reference numeral 51 a filter, the reference numeral 52 an ultraviolet radiation device, the reference numeral 53 an impurity sensor, and the reference numeral 54 a back pressure regulating valve. The circulation pump 50, the filter 51, the ultraviolet radiation device 52, the impurity sensor 53, and the back pressure regulating valve 54 are connected to each other through a circulation line 55 to constitute a circulation-filtration system through which water W2 recovered in the primary tank 40 is circulated. Pressure gauges 56, 57 for detecting a pressure differential between the pressure of the inflow side and the pressure of the outflow side of the filter 51 are connected to the circulation line 55, respectively, at upstream and downstream sides of the filter 51.

Pure water which has been regenerated by removing impurities with the filter 51 is flowed into a regenerated pure water tank 59 through a regenerated pure water line 58. A pressure gauge 60 and a back wash line 62 are connected to the regenerated pure water line 58, and a flow meter 61 is disposed in the regenerated pure water line 58. The reference numeral 63 denotes a pure water supply line for supplying pure water from a pure water source 64. The back wash line 62 and a pure water supplementary line 65 for adding supplementary pure water to the regenerated pure water tank 59 are connected to the pure water supply line 63. Further, an initial pressure gauge 66 is connected to the pure water supply line 63, and a regulator 67 and a check valve 68 are disposed in the pure water supply line 63. Further, a flow meter 69 is disposed in the pure water supplementary line 65. A line 63*a* for preventing generation of dead water is provided in the pure water supply line 63, and is connected to a waste water line 46 (not shown in FIG. 4).

An overflow line 70 for returning regenerated pure water overflowing the regenerated pure water tank 59 to the primary tank 40 is connected to the regenerated pure water tank 59. Further, in the regenerated pure water tank 59, there are provided a water level sensor 71 for detecting minimum water level, a water level sensor 72 for detecting low water level sensor 73 for detecting water level sensor 74 for and a pH sensor 76. A filter of a change in liquid level of regenerated pure water W3 is connected to the upper part of the regenerated pure water tank 59. The overflow line 70 has a U-shaped liquid pool portion 70*a* for preventing the atmosphere (exhaust atmosphere) within the primary tank 40 from flowing into the regenerated pure water tank 59.

The filter 51 for removing impurities comprises an ultrafilter membrane or a ceramic filter which has advantages over conventional filters in that it is not necessary to replace it with another one and clogging is less likely to occur. Pure water W1 of a predetermined pressure is periodically supplied to the regenerated pure water line 58 through the water level, a intermediate water level, a detecting maximum water level, 75 for respiration at the time back washing line 62 to perform back wash of the filter 51. Alternatively, when a pressure differential between the pressure of the inflow side and the pressure of the outflow side of the filter 51, which is monitored by the pressure gages 56, 57, has exceeded a predetermined value, the water W1 of a predetermined pressure may be supplied to the regenerated pure water line 58. Ultraviolet light is radiated from the ultraviolet radiation device 52 to the recovered water W2 which is circulated through the circulation line 55 for preventing the generation of bacteria in the recovered water W2.

Further, the concentration of impurities in the recovered and circulated water W2 is monitored by the impurity sensor 53. When the impurity concentration has exceeded a predetermined value, a valve V1 is opened and a valve V2 is closed to discharge the recovered water through the waste water line 46. The impurity sensor 53 comprises a specific resistance meter for measuring the specific resistance of water, or a particle counter for counting particles contained in water.

A supply pump 77, a supply filter 78, an impurity sensor 79, and an on-off valve 80 with a throttle are disposed in the regenerated pure water supply line 32 through which the regenerated pure water W3 is supplied from the regenerated pure water tank 59 to the substrate polishing mechanism 11 in the polishing apparatus 10. Further, a pressure sensor 81 and a relief valve 82 are connected to the regenerated pure water supply line 32. A supply pump 83, a supply filter 84, an impurity sensor 85, and an on-off valve 86 with a throttle are disposed in the regenerated pure water supply line 33 through which the regenerated pure water is supplied to the substrate polishing mechanism 21 in the polishing apparatus 20. Further, a pressure sensor 87 and a relief valve 88 are connected to the regenerated pure water supply line 33.

Each of the supply pumps 77, 83 can control supply conditions (pressure or flow rate) of the regenerated pure water by controlling its rotational speed with an inverter. While the water pressure in the regenerated pure water supply lines 32, 33 is being monitored by the pressure sensors 81, 87, the regenerated pure water W3 is supplied to the substrate polishing mechanisms 11, 21 at water pressures suitable for conditions of use of the substrate polishing mechanisms 11, 21. The on-off valves 80, 86 serve to regulate the pressure and flow rate of the regenerated pure water to be supplied to the substrate polishing mechanisms 11, 21. When the regenerated pure water is supplied to the substrate polishing mechanisms 11, 21 through the regenerated pure water supply lines 32, 33, valves V4, V5 are opened, a valve V3 is closed, and the supply pumps 77, 83 are actuated. A recirculating line is constituted by the recovery line 30, the primary tank 44, the circulation line 55, the regenerated pure water tank 59, and the regenerated pure water supply lines 32, 33. The recirculating line and the polishing apparatuses 10, 20 constitute a polishing system according to the present invention.

The water level of the regenerated pure water W3 within the regenerated pure water tank 59 is monitored by the water level sensors 71, 72, 73 and 74, and the supply pumps 77, 83 are operated by a control device (not shown) to add the supplementary pure water to the regenerated pure water tank 59 through the pure water supplementary line 65.

Each piece of equipment constituting the water recovery and regeneration apparatus 34 is housed in a casing 90. Water collected in a liquid reservoir 91 provided at the bottom of the casing 90 is discharged through a drain pipe 92. A water leak sensor 93 is provided in the liquid reservoir 91. In FIG. 4, the reference numeral 89 denotes a valve for discharging the recovered water W2 within the primary tank 40.

Figure 5:
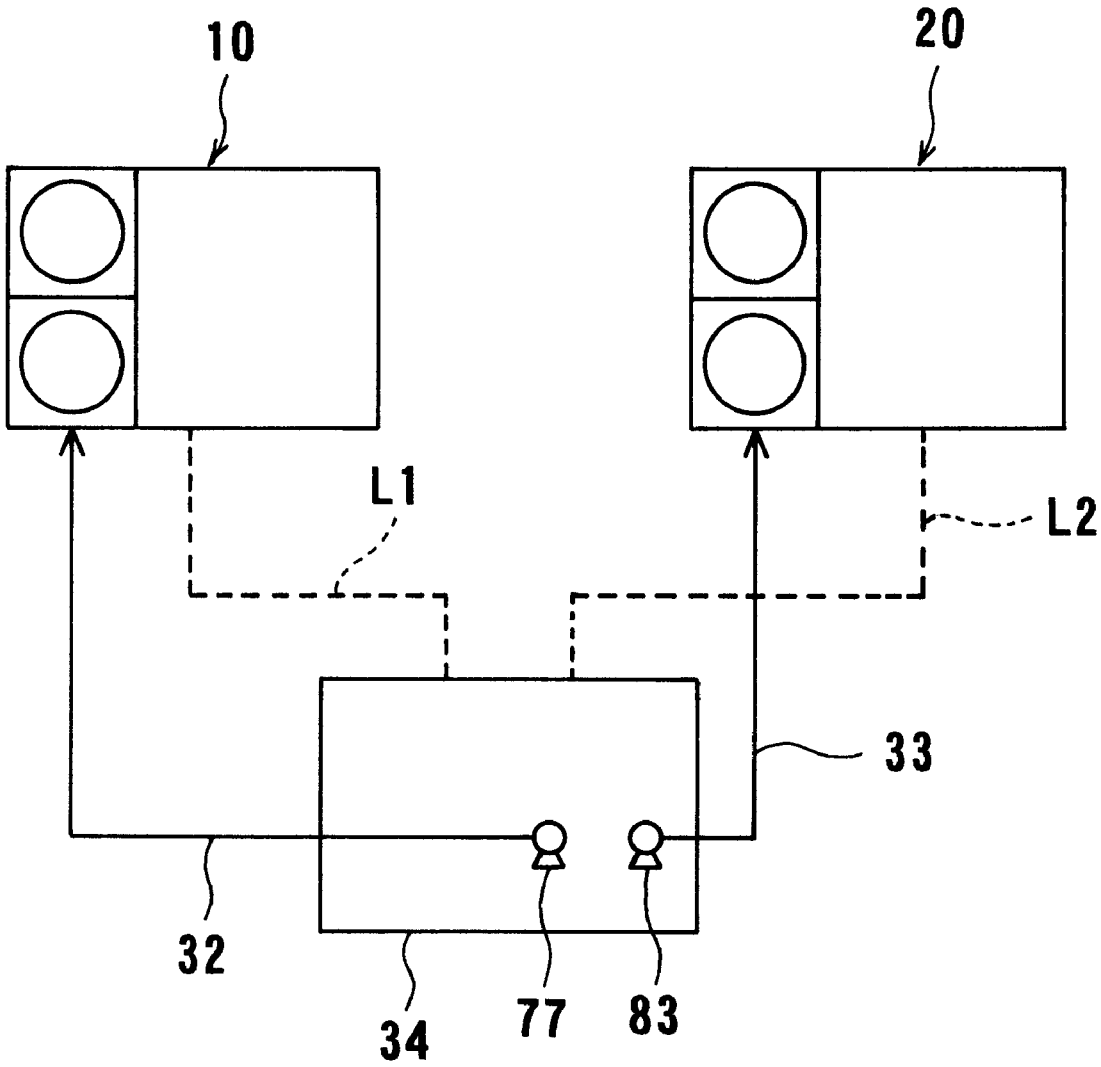
FIG. 5 is a schematic diagram explanatory, of the state of communication between polishing apparatuses and water recovery and regeneration apparatus according to the present invention.

Communication between the polishing apparatuses and the water recovery and regeneration apparatus 34 will be described below with reference to FIG. 5. As described above, the regenerated pure water is supplied from the water recovery and regeneration apparatus 34 to the polishing apparatuses 10, 20 after its water pressure is for the polishing apparatuses pressure varies depending upon apparatuses 10, 20. The necessary water pressure varies depending upon the condition of the polishing apparatuses 10, 20.

When a substrate is polished, a polishing liquid is supplied onto the polishing surface. Therefore, in this case, the regenerated pure water is used only in a portion around the polishing surface. Specifically, the pure water is supplied to the polishing apparatuses for preventing the dresser from being dried and for preventing the cover, serving to prevent scattering of the polishing liquid, from having the polishing liquid dried thereon. In this case, the flow rate of the regenerated pure water is small and water pressure of the regenerated pure water is low. At this time, the water recovery and regeneration apparatus 34 lowers the pressure of the regenerated pure water (0.03 to 0.3 MPa).

When the polishing surface is dressed after the polishing of the substrate is completed, it is necessary to clean the polishing surface and to supply regenerated pure water at a high pressure and a large flow rate to the polishing apparatuses. The rotational speed of the supply pumps (pressure rising pumps) 77, 78 in the water recovery and regeneration apparatus 34 is increased to supply the regenerated pure water at a high pressure and a large flow rate to the polishing apparatuses. Thus, the operating conditions of the water recovery and regeneration apparatus 34 are changed according to the condition of the polishing apparatuses 10, 20. Therefore, it is necessary to communicate between the water recovery and regeneration apparatus 34 and the polishing apparatuses 10, 20.

For the communication between the water recovery and regeneration apparatus 34 and the polishing apparatuses 10, 20, it is sufficient that contacts necessary for matching of timing are connected to each other. However, in this embodiment, the communication is performed through the use of a computer capable of monitoring each of the operating conditions. With this computer, it is possible to match the timing of rising the pressure of the regenerated pure water and simultaneously to set pressure rising conditions or supply pressure in the polishing apparatuses 10, 20. The water recovery and regeneration apparatus 34 is connected to the polishing apparatuses 10, 20, respectively through the communication lines (communication cables) L1, L2, and the discharge pressure of the supply pumps 77, 83 in the water recovery and regeneration apparatus 34 is controlled according to the conditions of the polishing apparatuses 10, 20.

As described above, the present invention has the following excellent effects.

According to the pure water reusing system of the present invention, an apparatus in which pure water is used and from which pure water is recovered and an apparatus in which pure water is used and to which the regenerated pure water is supplied are utilized for the same production process. Therefore, water to be recovered can be prevented from being contaminated by undesired waste water or chemical liquid. Further, a treatment process in a regeneration device can be simplified to reduce the size of the regeneration device. Furthermore, since the apparatuses are utilized for the same process, it is not necessary to increase the purity of the regenerated pure water to a high level.

With the supply pressure control mechanism, the regenerated pure water can be supplied at a pressure suitable for operating conditions of the apparatus in which pure water is used and to which the regenerated pure water is supplied. Further, the regenerated pure water can be utilized for a process requiring pure water of a pressure higher than that in the normal process.

Since the supply pressure control mechanism can vary the supply pressure of the regenerated pure water in response to a signal from the apparatus in which pure water is used, the regenerated pure water can be supplied at a desired pressure in accordance with required conditions, so that each of the apparatuses in which pure water is used can utilize the pure water under optimal operating conditions.

A passage of the water is switched between the recovery line and the waste water line according to the condition of the water discharged from the apparatus in which pure water is used. Therefore, water contaminated by impurities and unsuitable for recovery can be prevented from flowing into the recovery line, to thus improve the operating efficiency of the apparatus.

Although certain preferred embodiments of the present invention have been shown and described in detail, it should be understood that various changes and modifications may be made therein without departing from the scope of the appended claims.

What is claimed is:

1. A polishing system for polishing a substrate, said polishing system comprising:

a polishing apparatus being operable to conduct a polishing process on a substrate using pure water;

a water recovery section being operable to recover water used in the polishing process of said polishing apparatus;

a recovery line allowing the water used in the polishing process of said polishing apparatus to flow into said water recovery section; and a regeneration section being operable to regenerate the water recovered by said water recovery section to produce pure water, wherein at least one of said water recovery section and said regeneration section comprises a sensor being operable to detect whether the water is suitable for regeneration, and wherein said sensor comprises one of an optical turbidimeter, a pH meter, and a particle counter.

2. A polishing system for polishing a substrate, said polishing system comprising:

a polishing apparatus being operable to conduct a polishing process on a substrate using pure water;

a water recovery section being operable to recover water used in the polishing process of said polishing apparatus;

a recovery line allowing the water used in the polishing process of said polishing apparatus to flow into said water recovery section;

a regeneration section being operable to regenerate the water recovered by said water recovery section to produce pure water;

a recirculating line allowing water to be circulated through said water recovery section, said regeneration section and said polishing apparatus; and a sensor being operable to measure a flow rate of water in said recirculating line.

3. A polishing system according to claim 2, wherein said water recovery section recovers water which has been used for a predetermined process.

4. A polishing system according to claim 2, further comprising:

an additional recovering and regenerating apparatus being operable to recover water discharged from additional apparatuses and regenerate the water by removing impurities from the water to produce regenerated pure water, the regenerated pure water being used by the additional apparatuses to conduct the same processes in the additional apparatuses in which the pure water is used.

5. A polishing system according to claim 2, wherein the regenerated pure water is utilized for dressing a polishing surface used for polishing.

6. A polishing system according to claim 2, wherein said recirculating line comprises a supplementary pure water line being operable to add supplementary pure water to the regenerated pure water.

7. A polishing system according to claim 2, further comprising a regenerated pure water supply line for supplying the regenerated pure water to said polishing apparatus.

8. A polishing system according to claim 7, further comprising:

at least one additional regenerated pure water supply line; and a supply pressure control mechanism being operable to supply the regenerated pure water at an independent water pressure for each of said regenerated pure water lines.

9. A polishing system according to claim 8, wherein said supply pressure control mechanism is operable to vary the water pressure of the regenerated pure water in response to a signal from said polishing apparatus.

10. A polishing system according to claim 2, further comprising a switch value being operable to switch a passage of the water discharged from said polishing apparatus between said recovery line and a waste water line for discharging the water, wherein the passage of the water is switched between said recovery line and the waste water line according to a condition of the water discharged from said polishing apparatus.

* * * * *

UNITED STATES PATENT AND TRADEMARK OFFICE

CERTIFICATE OF CORRECTION

PATENT NO. : 6,508,695 B2
DATED : January 21, 2003
INVENTOR(S) : Mutsumi Tanikawa et al.

It is certified that error appears in the above-identified patent and that said Letters Patent is hereby corrected as shown below:

Column 10,
Line 52, insert the word -- supply -- after the phrase "regenerated pure water".

Signed and Sealed this

Twenty-seventh Day of May, 2003

JAMES E. ROGAN
*Director of the United States Patent and Trademark Office*